US010065095B2

(12) United States Patent
Gallagher

(10) Patent No.: US 10,065,095 B2
(45) Date of Patent: Sep. 4, 2018

(54) APPARATUS, SYSTEM AND METHOD FOR PLAYING AN OBJECT TOSS GAME

(71) Applicant: Martin Gallagher, Chicago, IL (US)

(72) Inventor: Martin Gallagher, Chicago, IL (US)

( * ) Notice: Subject to any disclaimer, the term of this patent is extended or adjusted under 35 U.S.C. 154(b) by 0 days.

(21) Appl. No.: 14/826,475

(22) Filed: Aug. 14, 2015

(65) Prior Publication Data

US 2016/0045799 A1 Feb. 18, 2016

Related U.S. Application Data

(60) Provisional application No. 62/037,807, filed on Aug. 15, 2014.

(51) Int. Cl.

| | |
|---|---|
| ***A63B 63/00*** | (2006.01) |
| ***A63B 67/10*** | (2006.01) |
| ***A63F 9/02*** | (2006.01) |
| ***A63B 67/06*** | (2006.01) |
| ***A63F 9/30*** | (2006.01) |
| ***A63F 9/34*** | (2006.01) |
| ***F41J 3/00*** | (2006.01) |

(52) U.S. Cl.

CPC ..... *A63B 67/10* (2013.01); *A63B 63/007* (2013.01); *A63B 67/06* (2013.01); *A63F 9/0208* (2013.01); *A63F 9/0278* (2013.01); *A63F 9/305* (2013.01); *A63F 9/34* (2013.01); *F41J 3/0009* (2013.01); *F41J 3/0071* (2013.01); *A63B 2209/08* (2013.01); *A63B 2209/10* (2013.01); *A63B 2225/09* (2013.01); *A63B 2225/093* (2013.01); *A63F 2009/0282* (2013.01)

(58) Field of Classification Search

CPC ..... A63B 67/10; A63B 67/06; A63B 63/007; A63B 2209/10; A63B 2225/09; A63B 2225/093; A63F 9/0208; A63F 9/0278; A63F 9/34; A63F 2009/0282; F41J 3/00

USPC ..... 273/330, 331, 332, 333, 334, 348.4

See application file for complete search history.

(56) References Cited

U.S. PATENT DOCUMENTS

| | | | | | |
|---|---|---|---|---|---|
| 742,416 | A | * | 10/1903 | Hall | 273/123 R |
| 922,717 | A | * | 5/1909 | Parker | A63B 67/06 273/401 |
| 2,021,989 | A | * | 11/1935 | De Master | A63F 9/0204 273/401 |
| 2,187,524 | A | * | 1/1940 | Price | A63F 7/40 248/363 |
| 2,291,104 | A | * | 7/1942 | Radzyner | G02B 27/06 273/441 |
| 2,477,531 | A | | 7/1949 | Volman | |
| 2,504,818 | A | * | 4/1950 | Findon | A63F 9/0204 273/402 |

(Continued)

*Primary Examiner* — Melba Bumgarner
*Assistant Examiner* — Joseph B Baldori
(74) *Attorney, Agent, or Firm* — Lempia Summerfield Katz LLC

(57) ABSTRACT

An object toss game has a ball connected to an elastic cord. The ball has a surface with fasteners. Two board assemblies are positioned at a distance apart. Pads are arranged on a top panel of each board assembly. Players toss the ball toward a pad on the board to remove the pad from the top panel. The ball then bounces from the top panel to remove the pad from the top panel. The first player to remove the pads from a board positioned opposite to the player wins the game. Alternately, players take turns tossing darts at regions on the board assemblies that are assigned points.

2 Claims, 4 Drawing Sheets

(56) References Cited

U.S. PATENT DOCUMENTS 2,683,037 A 7/1954 Ruczynski et al.
3,147,976 A 9/1964 Millar
3,176,989 A 4/1965 Harrison et al.
3,372,934 A * 3/1968 Heil ..... A63F 9/0204 273/342
3,709,495 A * 1/1973 Krombein ..... A63F 9/02 124/26
3,830,498 A 8/1974 Lauzon
3,837,650 A * 9/1974 Haney ..... A63F 9/001 273/402
3,967,823 A * 7/1976 Yount ..... F41J 3/0052 273/348.4
3,997,162 A 12/1976 Scullin
4,045,028 A * 8/1977 Dyess ..... A63B 67/06 273/338
4,055,343 A * 10/1977 Stuart ..... A63B 67/14 273/108
4,305,587 A 12/1981 O'Grady
4,323,250 A * 4/1982 Lansberry ..... A63F 7/305 206/315.1
4,326,709 A * 4/1982 Croyle ..... A63F 9/34 273/140
4,653,582 A 3/1987 Ehrenfried
4,709,929 A * 12/1987 Mills ..... A63B 63/08 273/402
4,736,955 A * 4/1988 Pollock ..... A63B 67/06 273/336
4,938,485 A * 7/1990 Hockridge ..... A63F 9/02 273/354
4,943,065 A * 7/1990 DeLapa ..... A63B 67/06 273/402
4,961,586 A * 10/1990 Conville ..... A63B 67/06 273/402
5,031,908 A 7/1991 Spector
5,056,796 A * 10/1991 Conville ..... A63B 67/06 273/402
5,056,797 A * 10/1991 Hockert ..... A63B 67/06 273/402
5,067,727 A * 11/1991 Crompton ..... A63B 67/06 273/336
5,110,136 A 5/1992 Land
5,141,465 A 8/1992 Stellman
5,201,527 A * 4/1993 Koket ..... A63B 71/0036 273/402
RE34,461 E * 11/1993 Buselli ..... A63F 9/0208 273/348.4
5,320,360 A * 6/1994 St. Pierre ..... A63F 9/0204 273/402
5,332,230 A * 7/1994 Benedict ..... A63B 67/06 273/400
5,358,742 A * 10/1994 Ziff ..... A63B 63/00 264/137
5,438,972 A 8/1995 Harbin
5,452,902 A 9/1995 Foster et al.
5,538,253 A 7/1996 Foster
5,549,302 A * 8/1996 Lapsker ..... A63B 63/00 273/348.4
5,549,304 A * 8/1996 Davis ..... A63B 63/004 273/396
5,566,949 A 10/1996 Gorden
5,570,889 A * 11/1996 Tyrer ..... A63B 63/00 273/348.4
5,613,684 A 3/1997 Gittens et al.
5,626,342 A 5/1997 Foster
5,722,663 A 3/1998 Avigal et al.
5,765,832 A * 6/1998 Huff ..... A63B 63/08 273/354
5,772,537 A * 6/1998 Anderson ..... A63B 69/0097 273/396
5,775,694 A 7/1998 Jonsson
6,099,381 A * 8/2000 Sodeshima ..... A63F 9/30 273/140
6,299,172 B1 * 10/2001 McMurray ..... A63F 9/0204 273/348.4
6,866,268 B2 * 3/2005 Christianson ..... A63B 65/10 273/398
6,899,335 B2 * 5/2005 Wilson ..... A63F 3/04 273/317
6,932,345 B1 * 8/2005 O'Dell ..... A63B 63/007 273/402
6,959,926 B2 * 11/2005 Melchiorri ..... A63F 3/00895 273/109
7,210,685 B2 * 5/2007 Cheng ..... A63B 43/005 273/348.4
7,237,777 B2 * 7/2007 Digges, III ..... A63B 67/06 273/400
7,607,665 B2 10/2009 Jordan
7,607,666 B1 * 10/2009 Studier ..... A63B 63/00 116/222
7,708,278 B2 5/2010 Norbits
7,775,525 B2 * 8/2010 Staver ..... A63B 67/06 273/317.1
7,976,414 B2 * 7/2011 McKay ..... A63B 69/0002 473/424
8,127,689 B2 * 3/2012 Christian ..... A47B 3/0912 108/11
8,162,318 B1 * 4/2012 Peterson ..... A63B 67/06 273/343
9,227,148 B2 * 1/2016 Rucker ..... A63F 7/0668
9,457,250 B1 * 10/2016 Jenkins ..... A63B 67/06
2007/0001399 A1 * 1/2007 Staver ..... A63B 67/06 273/317.3
2007/0080499 A1 * 4/2007 Greiwe ..... A63B 67/06 273/398
2008/0042360 A1 * 2/2008 Veikley ..... A63B 67/06 273/398
2009/0227399 A1 * 9/2009 McKay ..... A63B 69/0002 473/424
2009/0253541 A1 10/2009 Darville
2010/0120557 A1 * 5/2010 Klein ..... A63B 63/004 473/434
2012/0235356 A1 * 9/2012 Weiss ..... A63F 3/00028 273/398
2013/0026713 A1 * 1/2013 Angel ..... A63B 67/06 273/398
2013/0082442 A1 * 4/2013 Hanel ..... A63B 63/00 273/398
2014/0015198 A1 * 1/2014 Francis ..... A63B 63/00 273/398
2015/0115531 A1 * 4/2015 Ali ..... A63B 63/00 273/398
2016/0023095 A1 * 1/2016 Nally ..... A63B 67/06 273/343
2016/0045799 A1 * 2/2016 Gallagher ..... A63F 9/0208 273/334

* cited by examiner

APPARATUS, SYSTEM AND METHOD FOR PLAYING AN OBJECT TOSS GAME

CROSS REFERENCE TO RELATED APPLICATION

This Application claims the benefit of U.S. Provisional Application No. 62/037,807, filed Aug. 15, 2014, which is hereby incorporated in its entirety.

BACKGROUND OF THE INVENTION

The present invention generally relates to an apparatus, a system and a method for playing an object toss game, such as an object toss game having a ball connected to an elastic band and/or an object toss game having magnetic darts.

Outdoor games are often played to pass time, to meet new people and/or to enjoy weather. Conventional outdoor games often relate to tossing an object, such as a bean-bag and/or a ball, through a hole and/or a cut-out in a board that is positioned remotely from the player. Limited skill is generally necessary for an individual to play a bean-bag toss, for example. As a result, players often lose interest due to the simplicity of such a game.

Traditional games, such as a bean-bag toss, are turn based and may involve one or more players competing against one or more other players. The players attempt to toss the bean-bag into and through a hole and/or a cut-out in a board. The first player to successfully toss the bean-bag through the hole and/or who tosses the most bean-bags through the hole, for example, wins.

Other games may use different types of boards and/or objects to provide variants to the conventional object toss game. However, such variants continue to rely on the same basic premise of tossing an object through a hole. Thus, a need exists for an object toss game that requires skill, planning, strategy and/or effort to entertain and/or to engage the players. The present invention seeks to meet that need and to overcome the disadvantages commonly associated with known object toss games.

SUMMARY OF THE INVENTION

The present invention generally relates to an apparatus, a system and a method for playing an object toss game.

In an embodiment, the game may have two board assemblies with top panels that are generally trapezoidal and/or generally square in shape. The top panels may be constructed from wood, plastic, metal and/or any other similar rigid material. The top panels may have indicia on the surface (i.e. "Alley Games"). Pads, such as those made from hook and loop type fasteners, may be arranged on and/or attached to the top panels in rows and/or in columns.

To play the game, one or more players may be involved. Each player may attach discs with a top surface and a bottom surface to pads that may be attached to a top panel of the board assembly. The top surface and the bottom surface of the discs may have hook and loop type fasteners, for example. The discs and the pads may be circular in shape.

The boards may be placed remotely from one another. Discs may be attached to pads that may be mounted on the boards. The players may then use an object, such as a ball, that may be secured to an elastic cord. The ball may have an exterior surface made from hook and loop type fasteners, for example. The players may toss the ball toward the board to remove the discs when the surface of the ball contacts the discs. The ball then, for example, may bounce and/or recoil from the board to remove the disc from the pad attached to the board. The first player to successfully remove the discs from the board of the opposing player wins the game.

In another embodiment of the invention, the game may have two boards which are generally circular in shape. The boards may be constructed from metal and/or any other similar rigid material having magnetic properties. The boards may also have indicia on the surface.

To play the game, one or more players may be involved. The boards may be placed and/or arranged remotely from one another. The players may use an object, such as a metal dart with a tip. The dart may be tossed toward the board to land in a region of the board. Each region of the board may be assigned a different point value that may be relative to the difficulty of hitting the region as in, for example, a conventional dart game. Players may then take turns tossing darts until the darts are used. In an embodiment, the player who accumulates the highest number of total points wins the game.

In another embodiment of the invention, the game may have two boards that may be generally square in shape. The boards may be constructed from metal and/or any other similar material that may have magnetic properties. The boards may have indicia on the surface.

To play the game, one or more teams of, for example, at least two players per team are involved. The boards may be generally square in shape and may be placed remotely from each other. The players may then use an object, such as, for example, a dart with a magnetic tip. The dart is tossed toward the board of the opposing team to land in a region of the board. Each region of the board may be assigned a different point value relative to the difficulty of hitting the region as in, for example, a conventional dart game. The regions have the shape of, for example, a triangle and/or a pie slice. Players on each team may take turns tossing darts until the darts are used. For example, a first player and a second player on a team may toss darts toward the board of an opponent. In return, for the turn of the opposing team, a first player and a second player on an opposing team may toss darts toward the board of the other team. If two players from the same team hit the same region twice consecutively on the turn of their team, the two players may place a cover, such as a magnet, over any number on their board to make the game more challenging for the opposing team. In an embodiment, the team that accumulates a pre-determined number of points or the most points wins the game.

To this end, in an embodiment of the present invention, a game is provided. The game may have a top panel, a disc, a bottom panel, an object and/or a first cord. The top panel may a front surface and a back surface positioned opposite to the front surface. The disc may be connected to the front surface of the top panel wherein the disc may be removable from the front surface of the top panel. The bottom panel may be connected to the top panel to form an acute angle between the top panel and the bottom panel. The object may have an exterior with a fastener wherein the object may contact the disc to remove the disc from the front surface of the top panel wherein the object may have holes extending into the object. The first cord may be made of an elastic material and extending from the holes of the object wherein the first cord may form a loop.

In an embodiment, the game may have a second cord connected to the object wherein the second cord may be made of an elastic material and further wherein the second cord may extend through the loop of the first cord and secure the second cord to the first cord.

In an embodiment, the game may have a loop enclosure connected to the object wherein the loop enclosure may fit a finger of a player.

In an embodiment, the game may have a post having a first end and a second end positioned opposite to the first end wherein the first end of the post may be connected to the top panel and the second end of the post may be connected to the bottom panel.

In an embodiment, the game may have a pad secured to the front surface of the top panel wherein the pad may have a fastener and connect the disc to the front surface of the top panel.

In an embodiment, the game may have a first receptacle on the top panel wherein the first receptacle may be defined by an opening that extends through the top panel.

In an embodiment, the game may have a clamp having a curve and extending from the front surface of the top panel to the back surface of the top panel wherein the clamp may connect the top panel to the bottom panel and further wherein the clamp may be secured to the top panel.

In an embodiment, the game may have a second receptacle on the bottom panel wherein the second receptacle may be defined by an opening that extends into the bottom panel.

In an embodiment, the game may have a slot that may be generally U-shaped and extends through the top panel.

In another embodiment of the present invention, a method for playing a game with a player and a board that may have a top panel and a bottom panel is provided. The method may have the step of inserting a post into a receptacle in the board to adjust an angle between the top panel and the bottom panel wherein the receptacle may be shaped to house the post and further wherein the top panel may have a disc that may be removable from the board. The method may have the step of grasping an object having an exterior with a fastener. The method may have the step of tossing the object in a direction toward the board. The method may have the step of holding a cord that may be connected to the object and made of an elastic material. The method may have the step of contacting the object to the disc to remove the disc from the board.

In an embodiment, the method may have the step of attaching the disc to the board.

In an embodiment, the method may have the step of attaching a pad on the top panel to the disc.

In an embodiment, the method may have the step of recoiling the object in a direction away from the board.

In an embodiment, the method may have the step of inserting a finger of the player into a loop on the cord.

In an embodiment, the method may have the step of attaching the fastener on the exterior of the object to a fastener on the disc.

In another embodiment of the present invention, a game is provided. The game may have a top panel, a bottom panel, a post, a disc, a pad and/or an object. The bottom panel may be connected to the top panel and may have a receptacle that extends into the bottom panel to define an opening in the bottom panel. The post may have a first end and a second end positioned opposite to the first end wherein the first end of the post may extend into the receptacle and the second end of the post may contact the top panel. The disc may have a fastener attached to the top panel wherein the disc may be removable from the top panel. The pad may be connected to the top panel and the disc wherein the pad may have a fastener that attaches the disc to the top panel. The object may have a fastener wherein the object may be tossed in a direction toward the top panel to contact the disc and further wherein the fastener on the object attaches to the fastener on the disc to remove the disc from the top panel.

In an embodiment, the game may have a cord attached to the object wherein the cord may be made of an elastic material.

In an embodiment, the game may have a slot that extends through the top panel.

In an embodiment, the game may have a clamp secured to the top panel wherein the clamp may extend around the bottom panel to connect the top panel to the bottom panel.

In an embodiment, the game may have a protrusion extending from the post wherein the protrusion may be shaped to insert into a receptacle in the top panel.

Accordingly, it is an advantage of the present invention to provide an apparatus, a system and a method for playing an object toss game with an object, such as a ball.

Another advantage of the present invention is to provide an apparatus, a system and a method for playing an object toss game with an object, such as a dart.

Yet another advantage of the present invention is to provide an apparatus, a system and a method for playing an object toss game with two boards positioned remotely from one another.

An additional advantage of the present invention is to provide an apparatus, a system and a method for playing an object toss game with an object with a surface having hook and loop fasteners.

An additional advantage of the present invention is to provide an apparatus, a system and a method for playing an object toss game by tossing an object connected to a cord to remove discs attached to pads mounted on a board.

Still another advantage of the present invention is to provide an apparatus, a system and a method for playing an object toss game that requires the players to accumulate points.

A further advantage of the present invention is to provide an apparatus, a system and a method for playing an object toss game having two boards with regions assigned point values.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

In the following detailed description, reference is made to the accompanying figures which form a part hereof. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented. It will be readily understood that the aspects of the present disclosure, as generally described herein, and illustrated in the figures, may be arranged, substituted, combined and designed in a wide variety of different configurations, which are explicitly contemplated and form part of this disclosure.

Figure 1:
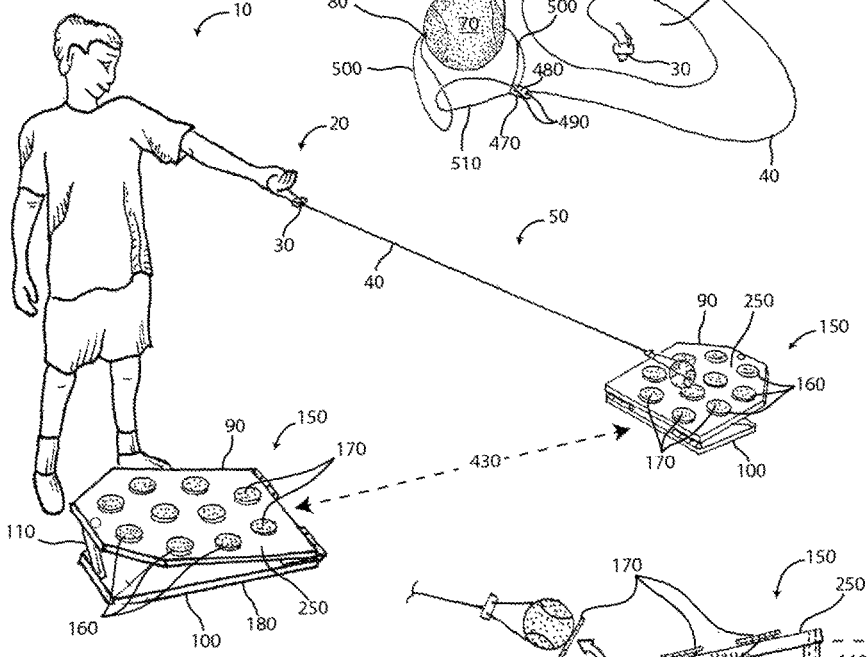
FIG. 1 illustrates an object toss game having two boards positioned remotely from each other in accordance with an embodiment of the present invention.
Figure 5:
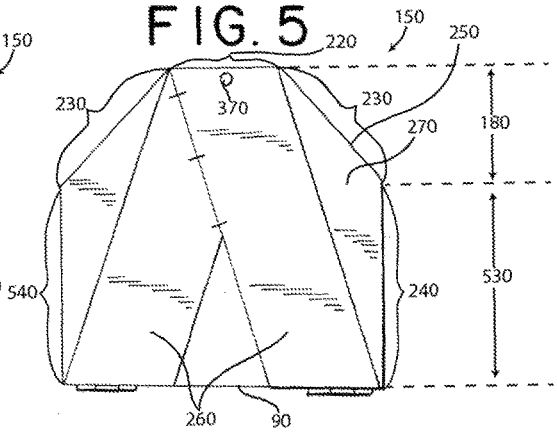
FIG. 5 illustrates a bottom view of a board in accordance with an embodiment of the present invention.
Figure 6:
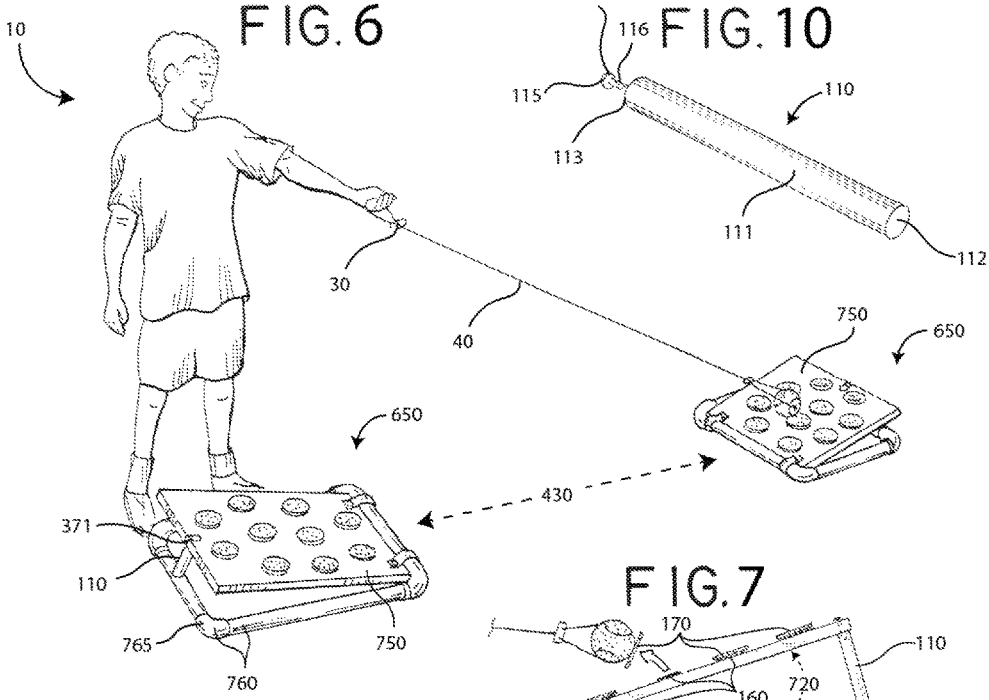
FIG. 6 illustrates an object toss game having two boards positioned remotely from each other in accordance with an embodiment of the present invention.

Referring now to FIGS. 1 and 6, perspective views of an embodiment of an object toss game 50 is shown. In the embodiment of the object toss game 50 shown in FIGS. 1-5, a player 10 may place and/or may position a board assembly 150 at a distance 430 apart from another board assembly 150'. In the embodiment of the object toss game 50 shown in FIGS. 6-9, the player 10 may place and/or may position a board assembly 650 at the distance 430 apart from another board assembly '650. It should be understood that the object toss game 50 may be played with the board assembly 150, the board assembly 150', the board assembly 650 and/or the board assembly 650'. In an embodiment, the board assembly 150 and the board assembly 150' may be identical. In an embodiment, the board assembly 650 and the board assembly 650' may be identical. The board assembly 150, the board assembly 150', the board assembly 650 and/or the board assembly 650' may be placed on any surface, such as a lawn, if the embodiment of the object toss game 50 is played outside. The embodiment of the object toss game 50 may be played inside. The board assembly 150, the board assembly 150', the board assembly 650 and/or the board assembly 650' may be placed, positioned and/or mounted on a floor, carpet, table and/or the like. In a preferred embodiment, the distance 430 is approximately six feet, for example. The distance 430 may be altered as needed.

To begin playing the first variation of the object toss game 50, the player 10 may insert a finger from his or her hand 20 through a loop enclosure 30 at a first end 460 of an elastic cord 40. Alternatively, in an embodiment, the player 10 may wrap a strap, not shown in the FIGS., around his or her wrist. The strap may accommodate a variety of wrist sizes, for example, and may be attached to the cord 40 at, for example, the first end 460. The elastic cord 40 may be made, constructed and/or fabricated from an elastomer and/or a similar stretchable fabric, for example. The elastic cord 40 may expand, contract and/or recoil to facilitate playing the embodiment of the object toss game 50.

In an embodiment, the elastic cord 40 may be a bungee cord composed of one or more elastic strands forming a core. The core may be covered by a woven cotton, for example, or a polypropylene sheath. In another embodiment, the elastic cord 40 may be, for example, a Stretchrite® elastic cord, and/or a ULINE® bungee cord. The registered trademark Stretchrite® is owned by Dyno, LLC, a limited liability company registered in Florida. The registered trademark ULINE® is owned by Uline, Inc., a corporation incorporated in Delaware. In an embodiment, the elastic cord 40 may have a width of one-sixteenth of an inch to one-eighth of an inch. In a preferred embodiment, the width of the elastic cord is one-sixteenth of an inch. Such a width of one-sixteenth of an inch for the elastic cord may be selected, for example, for its beneficial properties and/or ability to easily thread through the connection holes 80 on and/or in an object 60. Heavier and/or wider elastic cords may be selected to accommodate larger objects, for example.

Figure 2:
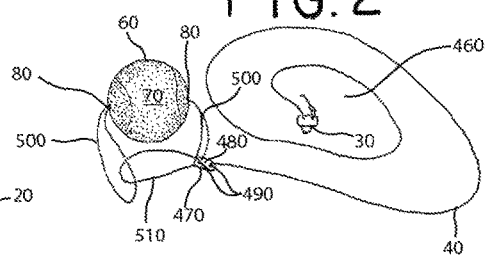
FIG. 2 illustrates a ball connected to a cord in accordance with an embodiment of the present invention.

As shown in FIG. 2, the elastic cord 40 may connect and/or attach to the object 60 at a second end 470 of the elastic cord 40. The object 60 may be a ball, for example. In an embodiment, the object 60 and may connect and/or may attach to the elastic cord 40 at connection holes 80 that may be diametrically opposed to each other on the object 60. In an embodiment, the connection holes 80 may penetrate through a surface 70 of the object 60. The surface 70 of the object 60 may have hook and loop fasteners, for example, and/or any other type of fastening system. Alternatively, the surface 70 may have an adhesive, for example. An ancillary elastic cord 500 may thread through and/or may loop around the connection holes 80 to emerge from the object 60 as shown in FIG. 2.

The elastic cord 40 may feed into and/or wrap around the ancillary elastic cord 500 and may return to a junction point 480 that may be made from plastic. The junction point 480 may have two fasteners 490 that may connect and/or may attach to the elastic cord 40 to form a closed loop section 510 that may be interconnected to the ancillary elastic cord 500 as shown in FIG. 2. The length and/or area defined by the closed loop section 510 may be adjusted by feeding and/or threading more or less of the elastic cord 40 through and/or around the ancillary elastic cord 500 to accommodate various sizes of the object 60. For example, more of the elastic cord 40 may be fed through, in and/or around the fasteners 490 of the junction point 480 to create a longer and/or larger closed loop section to accommodate a larger object, if needed, and/or to accommodate shorter ancillary elastic cords, if needed. Alternatively, less of the elastic cord 40 may be arranged as described herein to accommodate a smaller object, if needed, and/or to accommodate longer ancillary elastic cords, if needed.

Both the elastic cord 40 and the ancillary elastic cord 500 may be selected based on a preference by the player 10, for example, who may want a tighter and/or faster recoil characteristic or a looser recoil characteristic depending on the difficulty desired for the embodiment of the object toss game 50.

Figure 3:
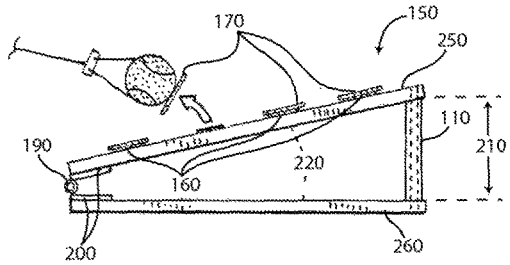
FIG. 3 illustrates a side view of a board in accordance with an embodiment of the present invention.

Referring now to FIG. 3, a side view of the board assembly 150 and/or the board assembly 150' is shown. The board assembly 150 and/or the board assembly 150' may be made from, constructed, fabricated and/or assembled from, for example, wood, particle board, metal and/or any other suitable substantially rigid material, such as poly-vinyl chloride ("PVC") and/or plastic, and/or any combination thereof, and/or may be formed by plastic injection molding. A post 110 may insert into a receptacle 370 as shown in FIGS. 3-5 and 10 to orient and/or install a top panel 250 at an angle 220 defined by a height 210 of the post 110. For example, if a higher post and/or a longer post is selected for the embodiment of the object toss game 50, then the angle 220 may be larger. In contrast, if a lower post and/or a shorter post is selected, the angle 220 may be smaller. The post 110 may be selected based on height to make the embodiment of the object toss game 50 more or less challenging, as desired. In an embodiment, the post 110 may be inserted into a slot 371 as shown in FIGS. 6-9.

Additionally, the board assembly 150 and/or the board assembly 150' may be collapsed by removing the post 110 to accommodate, for example, traveling with and/or movement of the board assembly 150 and/or the board assembly 150'. The top panel 250 may contact a base 260 of the board assembly 150 and/or the board assembly 150' and may be held in place by a rope, a cord and/or a twine threaded through the receptacle 370. The rope, the cord and/or the twine may be tied to prevent further movement of the top panel 250 and/or the base 260.

The top panel 250 may connect to the base 260 of the board assembly 150 and/or the board assembly 150' by a hinge joint 190. The hinge joint 190 may have two sections 200. Each of the sections 200 may flex, expand, unfold and/or attach to the top panel 250 and/or the base 260. Pads 160 may be arranged and/or may be attached directly on the top panel 250.

Figure 4:
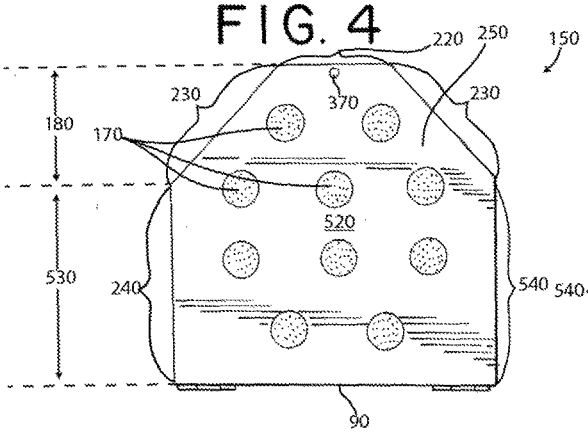
FIG. 4 illustrates a top view of a board with discs attached to pads in accordance with an embodiment of the present invention.

Referring now to FIG. 4, a top view of the top panel 250 of the board assembly 150 and/or the board assembly 150' is shown. The top panel 250 has a surface 520 that may have indicia written, printed and/or applied on the surface 520 which may be smooth and/or free from bumps, protuberances and/or the like. The pads 160 may be arranged and/or may be attached to the top panel 250 to form a row and/or a column. Alternatively, the pads 160 may be arranged to form a picture and/or a shape. Also, the pads 160 may be, for example, arranged randomly. In the embodiment shown in FIGS. 3 and 4, the pads 160 may be arranged in rows and/or columns. Each of the pads 160 may have a top surface having, for example, hook and loop type fasteners. Such hook and loop type fasteners may be VELCRO®, for example. The registered trademark VELCRO® is owned by Velcro Industries, B.V., a private limited liability company registered in The Netherlands. The pads 160 may be secured to the surface 520 by an adhesive (not shown), such as, for example, glue and/or the like. Removable discs 170, as shown in FIGS. 3 and 4, may be attached to and/or on top of the pads 160. The removable discs 170 may have a top surface and/or a bottom surface. The top surface and/or the bottom surface of the removable discs 170 may have, for example, hook and loop type fasteners as described herein. Fasteners on the bottom surface of the removable discs 170 may attach to fasteners on the top surface of pads 160 to attach and/or connect the removable discs 170 to the pads 160. The removable discs 170 may be arranged on the pads 160 as desired by attaching and/or detaching the fasteners of each the removable discs 170 and the pads 160.

The board assembly 150 and/or the board assembly 150' may be generally trapezoidal in shape with a top section 180 and/or a bottom section 530. The top section 180 may have a top center 220 that may be flanked by two connectors 230 that may extend from the top center 220 as shown in FIGS. 4 and 5. The bottom section 530 may have a left side 240 and/or a right side 540 that may be oriented in a position that may be perpendicular to the center 220. The bottom section may also have a bottom center 90 that may extend from the left side 240 to the right side 540.

Referring now to FIG. 5, an underside 270 of the board assembly 150 and/or the board assembly 150' is shown. Similar to the surface 520 of the top panel 250, the underside 270 may be smooth and/or free from bumps, protuberances and/or the like. As shown in FIG. 3, the flexible hinge joint 190 may connect and/or may attach the top panel 250 to the base 260. The base 260 may be set, placed and/or positioned on, for example, a substantially flat surface, such that the base is flush, parallel and/or in contact with the substantially flat surface. The base 260 may be made, constructed and/or fabricated from a rigid material such as wood, plastic, metal and/or the like. The top panel 250 and/or the base 260 may have the receptacle 370 and/or the slot 371 that may be, for example, bored through the top panel 250 and/or the base 260 in the top section of the board assembly 180 near the center 220. The post 110 may be inserted and/or may be threaded through the receptacle 370 and/or the slot 371 to orient and/or install the top panel 250 from the base 260 at an angle 220 as shown in FIG. 3, for example. The base 260 may have two portions that may be attached and/or connected to each other by staples and/or rivets, for example.

Figure 7:
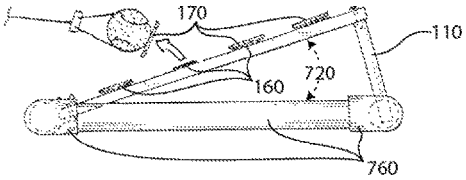
FIG. 7 illustrates a side view of a board in accordance with an embodiment of the present invention.
Figure 8:
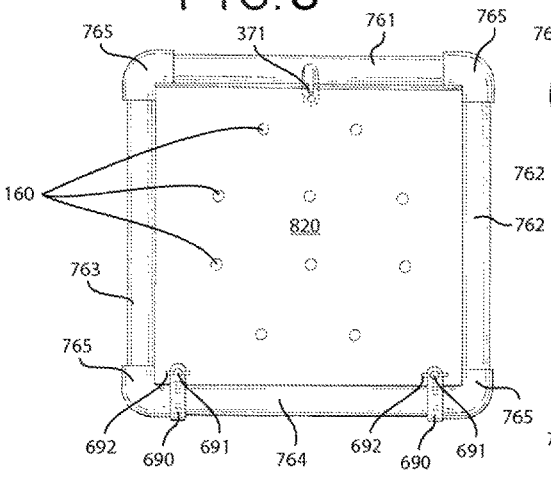
FIG. 8 illustrates a top view of a board with pads in accordance with an embodiment of the present invention.
Figure 9:
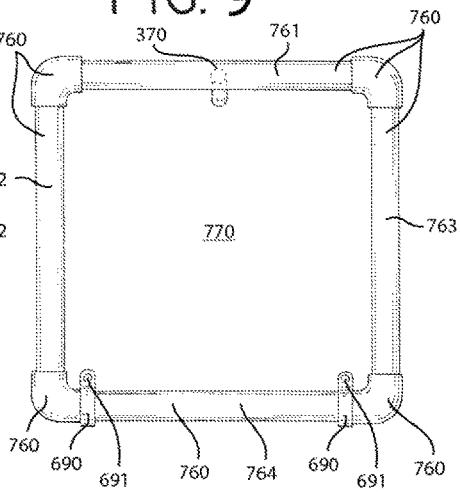
FIG. 9 illustrates a bottom view of a board in accordance with an embodiment of the present invention.

Referring now to FIG. 7, a side view of the board assembly 650 and/or the board assembly 650' is shown. The board assembly 650 and/or the board assembly 650' may be made from, constructed, fabricated and/or assembled from, for example, wood, particle board, metal and/or any other suitable substantially rigid material, such as PVC and/or plastic, and/or any combination thereof and/or may be formed by plastic injection molding. The post 110 may insert into the slot 371 as shown in FIGS. 8 and 9 and/or the receptacle 370 to orient and/or install a top panel 750 at an angle 720 defined by the height 210 of the post 110. For example, if a higher post and/or a longer post is selected for the embodiment of the object toss game 50, then the angle 720 may be larger. In contrast, if a lower post and/or a shorter post is selected, then the angle 720 may be smaller. The post 110 may be selected based on height to make the embodiment of the object toss game 50 more or less challenging, as desired.

Additionally, the board assembly 650 and/or the board assembly 650' may be collapsed by removing the post 110 to accommodate, for example, traveling with and/or movement of the board assembly 650 and/or the board assembly 650'. The top panel 750 may contact a base 760 of the board assembly 650 and/or the board assembly 650' and/or may be held in place by a rope, a cord and/or a twine threaded through the receptacle 370 and/or the slot 371. The rope, the cord and/or the twine may be tied to prevent further movement of the top panel 750 and/or the base 760. A cavity (not shown) may be created by contacting the base 760 of a collapsed board assembly 650 to the base 760 of a collapsed board assembly 650' to transport the object 60, the post 110 and/or other items.

The top panel 750 may connect to the base 760 of the board assembly 650 and/or the board assembly 650' by a clamp 690 having an aperture (not shown). In an embodiment, the clamp 690 may be a nylon loop clamp and/or may have a diameter of one and a half inches. It should be understood that the clamp 690 may be any clamp and/or may have a diameter of any size as known to one having ordinary skill in the art. A hole (not shown) may be, for example, bored through the top panel 750. A bolt 691 may extend through the aperture and/or the hole. A nut 692 may be connected to the bolt 691 and/or may secure the clamp 690 to the top panel 750 and/or the base 760.

Referring now to FIG. 8, a top view of the top panel 750 of the board assembly 650 and/or the board assembly 650' is shown. The top panel 750 has a top surface 820 that may have indicia written, printed and/or applied on the top surface 820 which may be smooth and/or free from bumps, protuberances and/or the like. The pads 160 may be arranged and/or may be attached directly on the top panel 750 to form a row and/or a column. Alternatively, the pads 160 may be arranged to form a picture and/or a shape. Also, the pads 160 may be, for example, arranged randomly. In the embodiment shown in FIGS. 7 and 8, the pads 160 may be arranged in rows and/or columns on the top panel 750. The top surface of the pads 160 may have fasteners, such as, for example, hook and loop type fasteners as described herein. The removable discs 170, as shown in FIGS. 6, 7 and 8, may be attached to and/or on top of the pads 160. The top surface and the bottom surface of the removable discs 170 may have fasteners, such as, for example, hook and loop type fasteners as described herein. Fasteners on the bottom surface of the removable discs 170 may attach to fasteners on the top surface of pads 160 to attach and/or connect the removable discs 170 to the pads 160 and/or the top panel 750. The removable discs 170 may be arranged on the pads 160 as desired by attaching and/or detaching the fasteners of each the removable discs 170 and/or the pads 160.

In an embodiment, the top panel 750 of the board assembly 650 and/or the board assembly 650' may be generally square in shape with a top side 680, a bottom side 681, a right side 682 and/or a left side 683. The top side 680 and/or the bottom side 681 may be substantially perpendicular to the right side 682 and/or the left side 683. In an embodiment, the top panel 750 may be generally shaped as a rectangle, a circle, an ellipse, a pentagon and/or the like and/or any combination thereof and/or any shape that allows the pads 160 and/or the removable discs 170 to be connected to the top panel 750 as known to one having ordinary skill in the art.

Referring now to FIG. 9, a bottom surface 770 of the board assembly 650 and/or the board assembly 650' is shown. Similar to the top surface 820 of the top panel 750, the bottom surface 770 may be smooth and/or free from bumps, protuberances and/or the like. As shown in FIGS. 7-9, the clamp 690 may connect the top panel 750 to the base 760. The clamp 690 may be secured to the top surface 820, the bottom surface 770 and/or the base 760. The clamp 690 may extend from the top surface 820 around the base 760 and/or contact the bottom surface 770.

Figure 10:
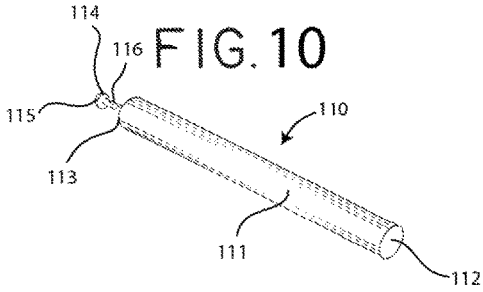
FIG. 10 illustrates a perspective view of a post in accordance with an embodiment of the present invention.

As shown in FIG. 10, the post 110 may be generally cylindrical. It should be understood that the post 110 may be any shape and/or size as known to one having ordinary skill in the art that may insert into the receptacle 370 and/or the slot 371. The post 110 may be made from, constructed, fabricated and/or assembled from, for example, wood, particle board, metal and/or any other suitable substantially rigid material, such as PVC and/or plastic, and/or any combination thereof and/or may be formed by plastic injection molding. The post 110 may have a shaft 111 that may have a first end 112 and/or a second end 113 that may be positioned opposite to the second end 113. In an embodiment, the first end 112 and/or the second end 113 may insert into the receptacle 370 and/or the slot 371. A protrusion 114 may be attached to and/or formed on the post 110. The protrusion 114 may insert into the receptacle 370 and/or the slot 371. In an embodiment, the post 110 may not have the protrusion 114. In an embodiment, the protrusion 114 may have a head 115 and/or a shank 116. The head 115 may be attached to and/or formed on the shank 116 which may have threads 117. In an embodiment, the threads 117 may secure the protrusion 114 to the shaft 111 of the post 110. As shown in FIG. 7, in an embodiment, the protrusion 114 and/or the shank 116 may insert into the slot 371 and/or the second end 113 of the shaft 111 may insert into the receptacle 370. The head 115 and/or the protrusion 114 may contact the top surface 820 of the top panel 750. The first end 112 and/or the shaft 111 may contact the bottom surface 770.

In an embodiment, the base 760 may be generally shaped as a square. However, it should be understood that the base 760 may be shaped as a circle, a rectangle, an ellipse, a pentagon and/or the like and/or a combination thereof. The base 760 may have a top leg 761, a right leg 762, a left leg 763 and/or a bottom leg 764. In an embodiment, the top leg 761 may be connected to the right leg 762 at a generally right angle and/or by a joint 765 that may be generally L-shaped. In an embodiment, the top leg 761 may be connected to the left leg 763 at a generally right angle and/or by the joint 765. In an embodiment, the bottom leg 764 may be connected to the right leg 762 at a generally right angle and/or by the joint 765. In an embodiment, the bottom leg 764 may be connected to the left leg 762 at a generally right angle and/or by the joint 765.

The base 760 may be set, placed and/or positioned on, for example, a substantially flat and/or horizontal surface, such that the base is flush, parallel and/or in contact with the substantially flat surface. The base 760 may be made, constructed and/or fabricated from a rigid material such as wood, plastic, metal and/or the like. The top panel 750 and/or the base 760 may have the slot 371 that may define a cut-out in the top panel and/or the base 760. As shown in FIGS. 6 and 8, the slot 371 may be generally U-shaped and/or may be shaped to fit the protrusion 114, the head 115, the shank 116 and/or the post 110. The top panel 750 and/or the base 760 may have the receptacle 370 and/or the slot 371 that may be, for example, bored through the top panel 750 and/or the base 760. As shown in FIG. 3, the receptacle 370 may be an opening that may be generally circular and/or may be shaped to house the protrusion 114, the head 115, the shank 116 and/or the post 110. The receptacle 370 and/or the slot 371 may extend partially through and/or completely through the top panel 750 and/or the base 760. The post 110 may be inserted into the receptacle 370 and/or the slot 371 to orient and/or install the top panel 750 from the base 760 at an angle 720 as shown in FIG. 7, for example. It should be understood that the top panel 750, the base 760, the top panel 250 and/or the base 260 may have the receptacle 370 and/or the slot 371.

To play the embodiment of an object toss game 50, as shown in FIGS. 1-5, the player 10, for example, may be standing as shown in FIG. 1, may be seated, and/or may be in any other position, such as, for example, behind the board assembly 150 and/or the board assembly '150; however, it should be understood that the board assembly 650 and/or the board assembly '650 shown in FIGS. 6-9 may be used in addition to and/or instead of the board assembly 150 and/or the board assembly '150 to play the object toss game 50. The player 10 may ready the board assembly 150 and/or the board assembly 150' for gameplay by orienting the top panel 250 relative to the base 260 by inserting the post 110 into the receptacle 370 and/or the slot 371 on the top panel 250 and/or the base 260 as shown in FIGS. 3-5. The fasteners on the bottom surface of the removable discs 170 may attach to the fasteners on the top surface of the pads 160 to attach and/or connect the removable discs 170 to the pads 160. In an embodiment, the fasteners may be hook and loop type fasteners. The hooks of the hook and loop fasteners of one surface, may, for example, loop into, around and/or connect with the loops of the hook and loop type fasteners of the opposing surface to attach the surface to the opposing surface.

The board assembly 150 and/or the board assembly 150' may be placed at a distance 430 apart, such as six feet for example, on a substantially flat surface that may be indoors and/or outdoors. The player 10 may select and/or lift an object 60 attached to an elastic cord 40 via a closed loop section 510 that may be interconnected to the ancillary elastic cord 500 at a junction point 480 as shown in FIG. 2. The player 10 may insert a finger on his or her hand 20 through the loop enclosure 30 at a first end 460 of the elastic cord 40 and hold the object 60. The player 10 may stand and/or may be seated at a position adjacent to the board assembly 150 and/or the board assembly 150' and may toss and/or may throw the object 60 at the board assembly 150 and/or the board assembly 150'.

The player 10 may stand next to the board assembly 150 and/or the board assembly 150', as shown in, for example, FIG. 1, and/or target one or more of the removable discs 170 that may be mounted and/or attached to the pads 160 on the top panel 250 of the board assembly 150 and/or the board assembly 150' to remove by, for example, 'picking off' the removable discs 170 from the pads 160. The surface 70 of the object 60 may have hook and loop type fasteners which may contact, compress and/or fasten to hook and loop type fasteners on a top surface of the discs 170. Momentum of the object 60 when, for example, thrown may be calculated and/or determined by multiplying a speed and/or velocity of the object 60 by a weight of the object 60. The momentum of the object 60 may provide a compressive force sufficient for the object 60 to adhere to and/or attach to the removable discs 170 from the pads 160 upon contact with the pads 160 as described herein. The object 60 may bounce and/or recoil from the top panel 250 to remove the removable discs 170 from the pads 160 that may be attached to the top panel 250 of, for example, the board assembly 150 and/or the board assembly 150' positioned opposite to the player 10.

The object 60 may return, for example, in a direction generally toward the player 10. The cord 40 may be attached to a finger of the hand 20 that may be inserted through the loop enclosure 30. The attachment of the cord 40 to a finger of the hand 20 of the player 10 may, for example, prevent the object 60 from traveling away from the player 10. The player 10 may then repeat the process by tossing the object 60 to remove the remaining removable discs 170 from the pads 160 that may be attached to the board assembly 150 and/or the board assembly 150' positioned opposite to the player 10. The first player to successfully remove the removable discs 170 from the top panel 250 of the board assembly 150 and/or the board assembly 150' of an opposing player wins the embodiment of the object toss game 50.

Figure 11:
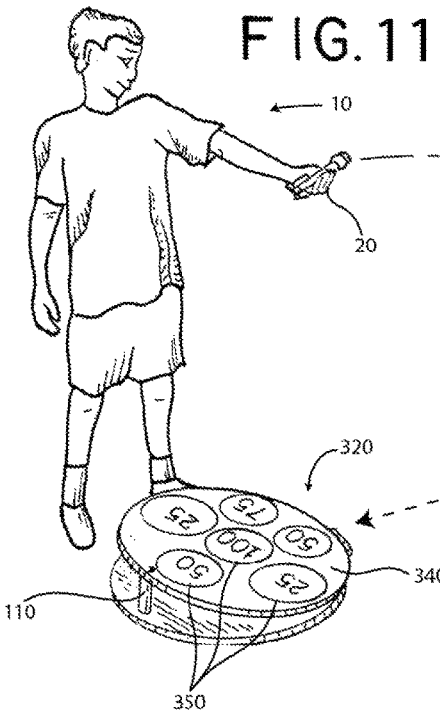
FIG. 11 illustrates an object toss game having two boards positioned remotely from one another in accordance with an embodiment of the present invention.

Referring now to FIG. 11, a perspective view of another embodiment of an object toss game 440 is shown. In an embodiment, the player 10 may place and/or position a circular board structure 320 at a distance 430 apart from another circular board structure 320' as shown in FIG. 11. In an embodiment, the circular board structure 320 and the circular board structure 320' may be identical. The circular board structure 320 and/or the circular board structure 320' may be placed on a surface, such as a lawn, if the second variation of the object toss game 440 is played outside. The second variation of the object toss game 440 may also be played inside. The circular board structure 320 and/or the circular board structure 320' may be placed, positioned and/or mounted on a floor, carpet, table and/or the like. In a preferred embodiment, the distance 430 may be six feet, for example. The distance 430 may be altered as needed.

Figure 12:
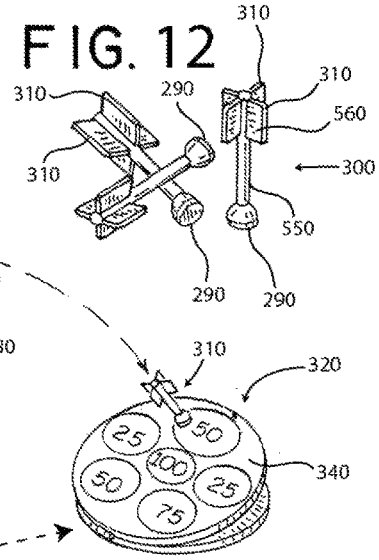
FIG. 12 illustrates a dart with a tip in accordance with an embodiment of the present invention.
Figure 13:
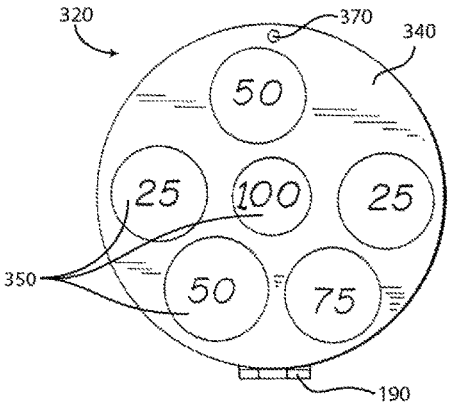
FIG. 13 illustrates a top view of a board with a region having point values in accordance with an embodiment of the present invention.
Figure 14:
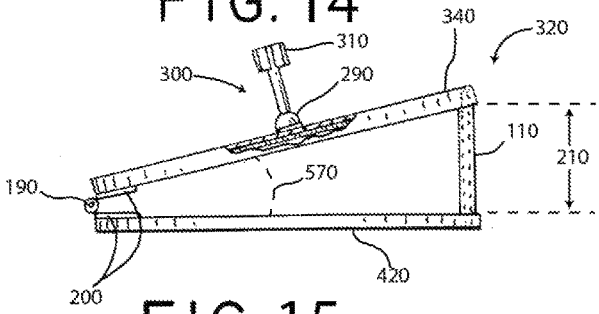
FIG. 14 illustrates a side view of a board in accordance with an embodiment of the present invention.

The circular board structure 320 and/or the circular board structure 320' may have a top surface 340 with regions 350 having identified point values as shown in FIGS. 11, 13 and 14. For example, the regions 350 may be circular in shape and enclose point values such as twenty-five, fifty, seventy-five and/or one hundred. In an embodiment, the point values may be assigned to the regions 350 arbitrarily. In another embodiment, the point values may be assigned according to the relative difficulty of hitting and/or striking the region 350 with a dart 300 as shown in FIGS. 11-14. For example, as shown in FIGS. 11 and 13, the region 350 with a point value of one hundred may be placed, located and/or oriented in a center of the circular board structure 320 and/or the circular board structure 320'.

Referring now to FIG. 12, the dart 300 is shown. The dart 300 may be made, constructed and/or fabricated from a metal, composite or any other similar material that may have and/or demonstrate magnetic properties. As shown in FIG. 12, the dart 300 may have a straight middle shaft 550 connecting an end 290 to one or more fins 310. The dart 300 and/or the end 290 of the dart 300 may be made, constructed and/or fabricated from a material having and/or demonstrating magnetism and/or magnetic properties. In an embodiment, the end 290 may be shaped generally as a semi-hemisphere and/or half-hemisphere. The fins 310 may have ridges 560 that may aid aerodynamic properties of the dart 300 as the dart 300 is tossed and/or thrown through the air by the player 10 at the regions 350 on the top surface 340 of the circular board structure 320 and/or the circular board structure 320'. The fins 310 may be placed, mounted and/or oriented to protrude and/or emerge from the shaft 550 as shown in FIG. 12.

A side view of the circular board structure 320 and/or the circular board structure 320' is shown in FIG. 14. The post 110 may be inserted into the receptacle 370 on the circular board structure 320 and/or the circular board structure 320' as shown in FIG. 14 to orient and/or install the top surface 340 to a base 420 via the hinge joint 190. In another embodiment, the post 110 may be inserted into the slot 371 on the circular board structure 320 and/or the circular board structure 320' to orient and/or install the top surface 340 to a base 420 via the hinge joint 190. The hinge joint 190 may have sections 200 that attach, mount and/or adhere to the top surface 340 and the base 420. The top surface 340 may be attached to the base 420 at an angle 570 dependent on the height 210 of the post 110. For example, a higher, taller and/or longer post 110 may contribute to a larger angle 570. Conversely, a smaller and/or shorter post 110 may contribute to a smaller angle 570.

As shown in FIG. 14, the end 290 of the dart 300 may adhere to and/or attach to the surface 340 of the circular board structure 320 and/or the circular board structure 320' by, for example, magnetism and/or magnetic attraction between magnetic material in the dart 300 and/or magnetic material in the circular board structure 320 and/or the circular board structure 320'. Magnetism and/or magnetic attraction generally describes a class of physical properties and/or processes that, for example, may include forces exerted by magnets on other magnets. The dart 300 may adhere and/or attach to the top surface 340 of the circular board structure 320 and/or the circular board structure 320' at, for example, a right angle as shown in FIG. 14.

Figure 15:
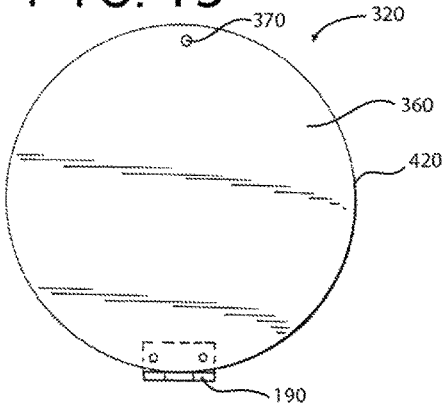
FIG. 15 illustrates a bottom view of a board in accordance with an embodiment of the present invention.

Referring now to FIG. 15, a rear surface 360 of the base 420 of the circular board structure 320 and/or the circular board structure 320' is shown. The receptacle 370 and/or the slot 371 may be positioned at and/or near a front and/or top of the base 420 as shown in FIG. 15. The hinge joint 190 may be positioned at and/or near a bottom of the base 420 as shown in FIGS. 14 and 15.

To begin playing the embodiment of the object toss game 440, one or more players may be involved. The circular board structure 320 and/or the circular board structure 320' may be placed and/or oriented at a distance 430 away from one another. For example, the player 10, standing as shown in FIG. 11 and/or behind the circular board structure 320 and/or the circular board structure 320', may lift the dart 300 with his or her hand 20 and toss and/or throw the dart 300 in a direction 280 generally toward the region 350 on the top surface 340 of the circular board structure 320 and/or the circular board structure 320'. The dart 300 may land in and/or adhere to a region of the board as shown in FIG. 11. Each region of the board may be assigned a different point value that may be relative to the difficulty of hitting the region as in, for example, a conventional dart game. One or more players 10 may take turns tossing and/or throwing the darts 300 until the darts are used and/or depleted. The player who accumulates the highest number of total points by adhering darts 300 to regions 350 wins the game.

Figure 16:
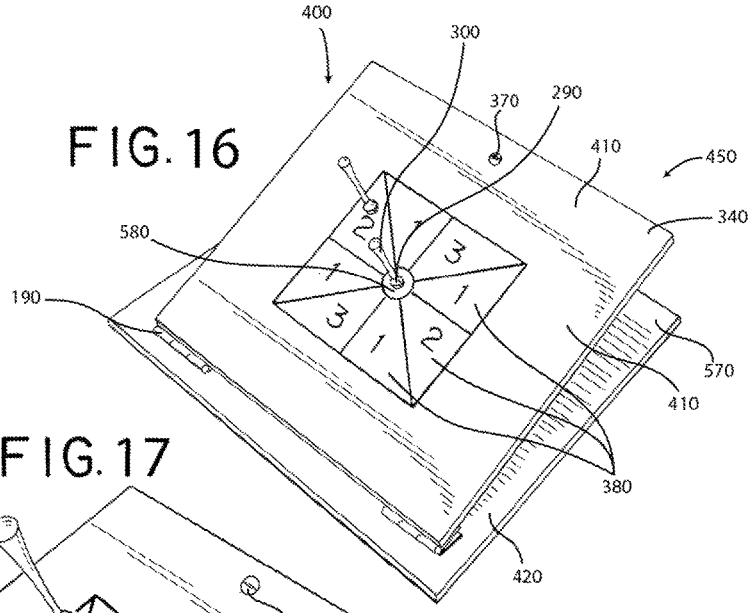
FIG. 16 illustrates a perspective view of a board having point values in accordance with an embodiment of the present invention.
Figure 17:
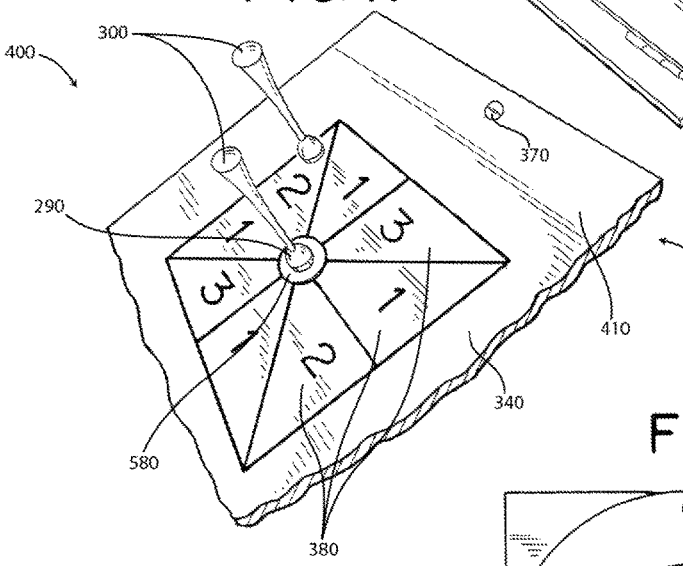
FIG. 17 illustrates a perspective view of a board having point values in accordance with an embodiment of the present invention.

Referring now to FIGS. 16 and 17, another embodiment of the object toss game 450 is shown. The embodiment of the object toss game 450 may have a square board structure 400 and/or a square board structure 400'. In an embodiment, the square board structure 400 and/or the square board structure 400' may have a top surface 340. The square board structure 400 and/or the square board structure 400' may be made, fabricated, and/or constructed from a magnetic material such as, for example, metal. As shown in FIGS. 16 and 17, the end 290 of the dart 300 may adhere to and/or attach to the top surface 340 of the circular board structure 320 and/or the circular board structure 320' by, for example, magnetism and/or magnetic attraction between magnetic material in the dart 300 and/or magnetic material in the circular board structure 320 and/or the circular board structure 320'.

Regions 380 may be oriented, placed, drawn and/or printed onto the top surface 340. As shown in FIGS. 16 and 17, the regions 380 may be generally shaped as, for example, triangles. A center region 580 may be located in a center of the regions 380. In an embodiment, the regions 380 may be assigned a point value as shown in FIGS. 16 and 17. The assignment of point values may, for example, depend on the relative difficulty of striking the region 380 with the dart 300.

The top surface 340 may be oriented to the base 420 at an angle 570 and may attach to the base 420 by the hinge joint 190. As shown in FIG. 16, the base 420 may be larger in size than the top surface 340 to provide, for example, additional stability.

FIG. 16 illustrates a perspective view of the square board structure 400 and/or the square board structure 400' of the embodiment of the object toss game 450. As shown in FIG. 16, the darts 300 may be constructed from a magnetic material and adhere to the square board structure by magnetic attraction, for example. In an embodiment, the darts 300 may not have fins 310 as shown in FIGS. 16 and 17. The darts 300 may adhere to the top surface 340 of the square board structure 400 and/or the square board structure 400' at, for example, a right angle. Further, the top surface 340 of the square board structure 400 and/or the square board structure 400' may have a peripheral region 410. In an embodiment, the peripheral region 410 may be generally shaped as a square and may not be assigned a point value. The receptacle 370 may penetrate a top portion and/or section of the peripheral region 410 as shown in FIGS. 16 and 17. In an another embodiment, the slot 371 may penetrate the top portion and/or section of the peripheral region 410. The post 110 may be inserted through the receptacle 370 and/or the slot 371 in the peripheral region 410 of the top surface 340 of the square board structure 400 and/or the square board structure 400' to orient and/or support the top surface 340 from the base 420.

Figure 18:
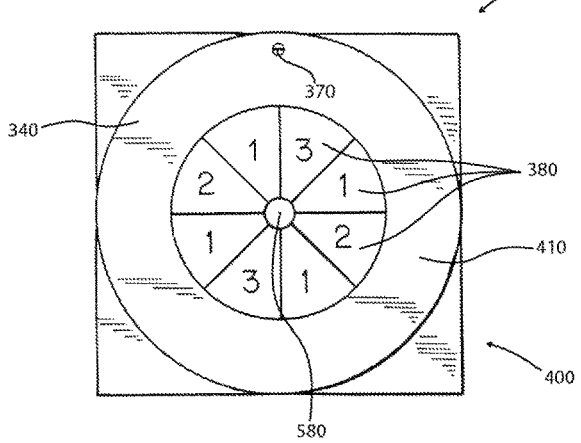
FIG. 18 illustrates a schematic view of a board having point values in accordance with an embodiment of the present invention.

Referring now to FIG. 18, a top view of another embodiment of the object toss game 590 is shown. In the embodiment of the object toss game 590, the top surface 340 of the square board structure 400 and/or the square board structure 400' may have regions 380 generally shaped as, for example, pie slices. The regions 380 may be assigned a point value. The peripheral region, as shown in FIG. 18, may be generally shaped as a circle and not assigned a point value. In an embodiment, each region of the regions 380 may be assigned a point value as shown in FIG. 18. The assignment of point values may, for example, depend on the relative difficulty of striking the region 380 with the dart 300. In an embodiment, the peripheral region 410 may define an outer boundary of the object toss game 450.

To play the embodiment of the object toss game 450 as shown in FIGS. 16 and 17 and to play the embodiment of the object toss game 590 as shown in FIG. 18, one or more teams of at least two players 10, as shown in FIG. 11, per team may be involved.

The square board structure 400 and/or the square board structure 400' may be placed remotely at a distance 430, as shown in FIG. 11, from each other. The players may stand relative to the square board structure 400 and/or the square board structure 400' as shown in, for example FIG. 11, and/or may stand behind the square board structure 400 and/or the square board structure 400'. The players may then use an object, such as a dart 300 with a tip 290. The dart may be tossed and/or thrown in a direction 280 generally toward the regions 380 of the top surface 340 of the square board structure 400 and/or the square board structure 400' positioned opposite to the player 10 as shown in FIG. 11. Each of the regions 380 of square board structure 400 and/or the square board structure 400' may be assigned a different point value relative to the difficulty of hitting the region as in, for example, a conventional dart game. The regions may have the shape of, for example, a triangle or a pie slice.

A player on each team may take turns tossing and/or throwing the darts 300 until the darts are used. For example, a first player and a second player on a team may toss darts toward the board of an opponent player. In return, for the turn of the opposing team, a first player and a second player on an opposing team may toss and/or throw the darts 300 generally toward the regions 380 of the top surface 340 of the square board structure 400 and/or the square board structure 400' of the other team.

In an embodiment, if two players from the same team hit the same region twice consecutively on the turn of their team, the two players may place a cover, such as a magnet, over any number and/or region 380 assigned a point value on their square board structure 400 and/or the square board structure 400' to make the game more challenging for the opposing team. Point totals may be determined by adding points earned and/or scored by players during the turn of their team. In an embodiment, the team that accumulates a pre-determined number of points or the most points wins the game. Accordingly, in an embodiment, players on a team may, for example, strategically target regions with specific point values to earn points as needed to accumulate a pre-determined number of points.

In another embodiment, the team that accumulates the highest number of points upon depleting a given supply of darts 300 wins the game. In yet another embodiment, any team that exceeds a pre-determined point total points will relinquish the points collectively earned by both players during their turn to begin at the score the team had at the beginning of the previous turn.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

I claim:

1. A game comprising:

at least two board assemblies spaced a distance apart, each of the at least two board assemblies further comprising:

a top panel, the top panel having a front surface and a back surface positioned opposite to the front surface;

a bottom panel connected to the top panel, the bottom panel being substantially parallel to the horizon, wherein the top panel is inclined with respect to the bottom panel to form an acute angle between the top panel and the bottom panel;

a plurality of pads connected to the front surface of the top panel, each pad of the plurality of pads having a first surface and a second surface opposite the first surface, the first surface of each pad secured to the front surface of the top panel and the second surface of each pad having a fastener; and a plurality of discs, wherein each disc of the plurality of discs is removably connected to a respective pad of the plurality of pads on the front surface of the top panel, wherein each disc of the plurality of discs has a top surface and a bottom surface opposite the top surface, each of the top surface and bottom surface having a fastener, wherein the fastener on the bottom surface of each disc of the plurality of discs connect to a respective fastener on the second surface of a respective pad of the plurality of pads on the front surface of the top panel;

an object having an exterior with a fastener and a hole extending through the object, the hole having a first end and a second end diametrically opposed to the first end, wherein the exterior is configured to attach to any of the fasteners on any of the top surfaces of any of the plurality of discs to remove any of the plurality of discs from the front surface of the top panel; and a cord made of an elastic material and having a first end and a second end, the first end extending through the hole of the object to connect the cord to the object, the second end forming a loop, wherein the loop is configured to be secured to a user.

2. The game of claim 1, wherein the cord has a thickness of between one-sixteenth of an inch and one-eighth of an inch.

* * * * *